US007273160B2

(12) United States Patent
Wey

(10) Patent No.: US 7,273,160 B2
(45) Date of Patent: Sep. 25, 2007

(54) NAILER MAGAZINE

(76) Inventor: Fwu-Lai Wey, No. 38, Lane 32, Nan-King Road, Taichung (TW)

( * ) Notice: Subject to any disclaimer, the term of this patent is extended or adjusted under 35 U.S.C. 154(b) by 162 days.

(21) Appl. No.: 11/026,867

(22) Filed: Dec. 30, 2004

(65) Prior Publication Data

US 2005/0150929 A1 Jul. 14, 2005

(30) Foreign Application Priority Data

Jan. 9, 2004 (TW) ..... 93200451 U

(51) Int. Cl.
*B27F 7/13* (2006.01)
*B27F 7/38* (2006.01)

(52) U.S. Cl. ..... 227/125; 227/127; 227/156

(58) Field of Classification Search ..... 227/156, 227/109, 119, 120, 121, 125, 127, 139
See application file for complete search history.

(56) References Cited

U.S. PATENT DOCUMENTS 2,707,277 A * 5/1955 Aldrich ..... 227/130
3,232,511 A * 2/1966 Crooks ..... 227/130
3,504,840 A * 4/1970 Wandel et al. ..... 227/130
3,622,062 A * 11/1971 Goode et al. ..... 227/130
3,672,029 A * 6/1972 Butriss ..... 29/243.56
3,854,648 A * 12/1974 Inzoli et al. ..... 227/136
4,270,687 A * 6/1981 Maurer ..... 227/113
5,163,596 A * 11/1992 Ravoo et al. ..... 227/109
5,370,295 A * 12/1994 Simonelli ..... 227/119
5,947,362 A * 9/1999 Omli ..... 227/120

* cited by examiner

*Primary Examiner*—Stephen F. Gerrity
*Assistant Examiner*—Paul Durand
(74) *Attorney, Agent, or Firm*—C. G. Mersereau; Nikolai & Mersereau, P.A.

(57) ABSTRACT

A nailer magazine includes a stationary part stably mounted on a bottom of a striking portion of a body of the nailer and a sliding part mounted to the stationary part and slideable along the stationary part in a longitudinal direction. A feeding device is mounted between the stationary part and the sliding part for pushing staples. A retraction device is mounted inside the stationary part. The retraction device moves the feeding device to a retracted position when detaching the sliding part from the stationary part and in a forward position for stably holding the staples when the sliding part is mounted to the stationary part and contacts with a valve mounted inside a bottom portion of the body of the nailer.

8 Claims, 8 Drawing Sheets

NAILER MAGAZINE

BACKGROUND OF THE INVENTION

1. Field of the Invention

The present invention relates to a nailer magazine and, more particularly, to a nailer magazine which is provided for preventing nails from being deformed.

2. Description of Related Art

A conventional nailer magazine in accordance with the prior art comprises a stationary part mounted on a striking portion of the nailer and a sliding part slidably mounted on the stationary part. A feeder with a pusher is disposed on the sliding part. The pusher uses the return force of a resilient element to push the staples. The distal end of the pusher always extends over the outer periphery of the sliding part when detaching or attaching the conventional nailer magazine. Consequently, the user arranges the staples to linearly correspond to the stationary part, and the pusher straightly pushes the staples when mounting the magazine.

However, the staples are in a free condition when the pusher initially contacts with the staples. Consequently, the staples may be deformed or bend due to an improper action mounting the conventional magazine. As a result, the staples may be jammed while operating the nailer.

The present invention has arisen to mitigate and/or obviate the disadvantages of the conventional nailer magazine.

SUMMARY OF THE INVENTION

The main objective of the present invention is to provide an improved nailer magazine for preventing the staples from being deformed and jammed while operating the nailer.

To achieve the objective, the nailer magazine in accordance with the present invention comprises a stationary part mounted on a bottom of a striking portion of a body of the nailer and a sliding part mounted to the stationary part and slideable along the stationary part in a longitudinal direction. A feeding device is mounted between the stationary part and the sliding part for pushing a set of fasteners in the preferred form of staples into the nailer. A retraction device is mounted inside the stationary part. The retraction device moves the feeding device to a retracted position when detaching the sliding part from the stationary part and to a forward position for stably holding the staples when the sliding part is mounted to the stationary part and the sliding part contacts a valve mounted inside a bottom portion of the body of the nailer. The reloaded staples are held securely between the stationary part and the sliding part to prevent the reloaded staples from being deformed when the feeding device initially contacts the reloaded staples.

Further objectives, benefits and advantages of the present invention will become apparent after a careful reading of the detailed description with appropriate reference to the accompanying drawings.

DETAILED DESCRIPTION OF THE INVENTION

Figure 1:
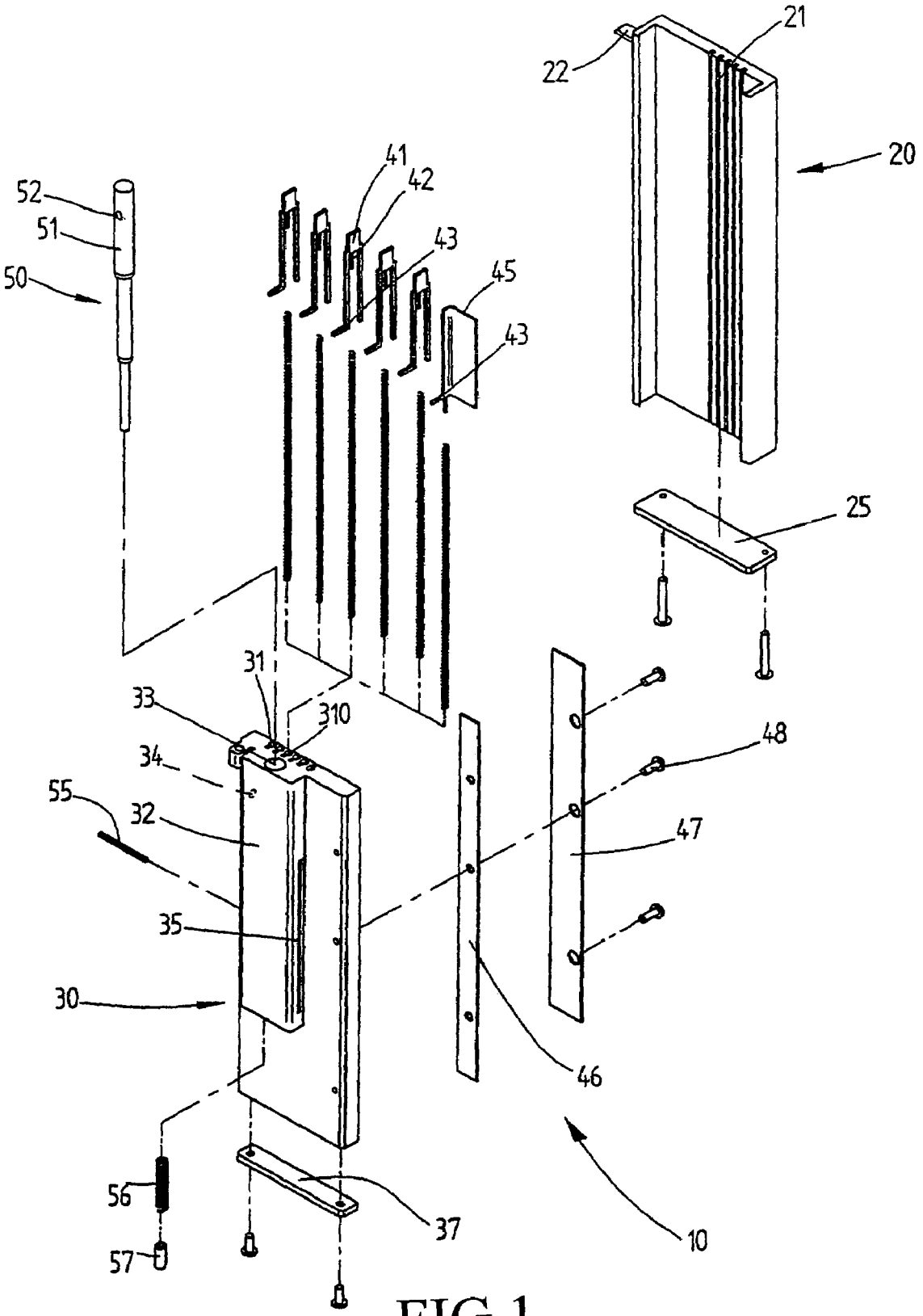
FIG. 1 is an exploded perspective view of a nailer magazine in accordance with the present invention.
Figure 2:
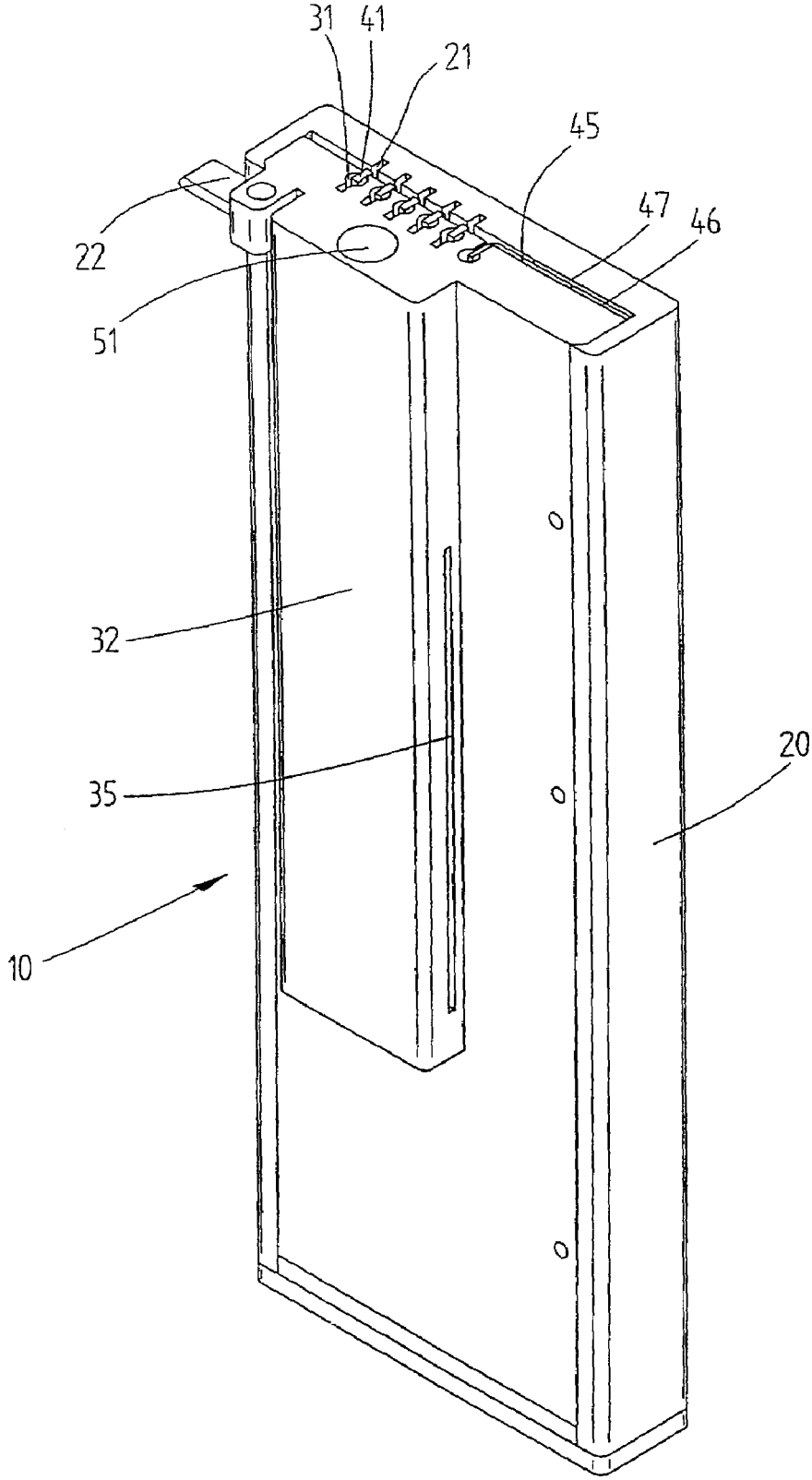
FIG. 2 is a perspective view of a nailer magazine in accordance with the present invention.
Figure 4:
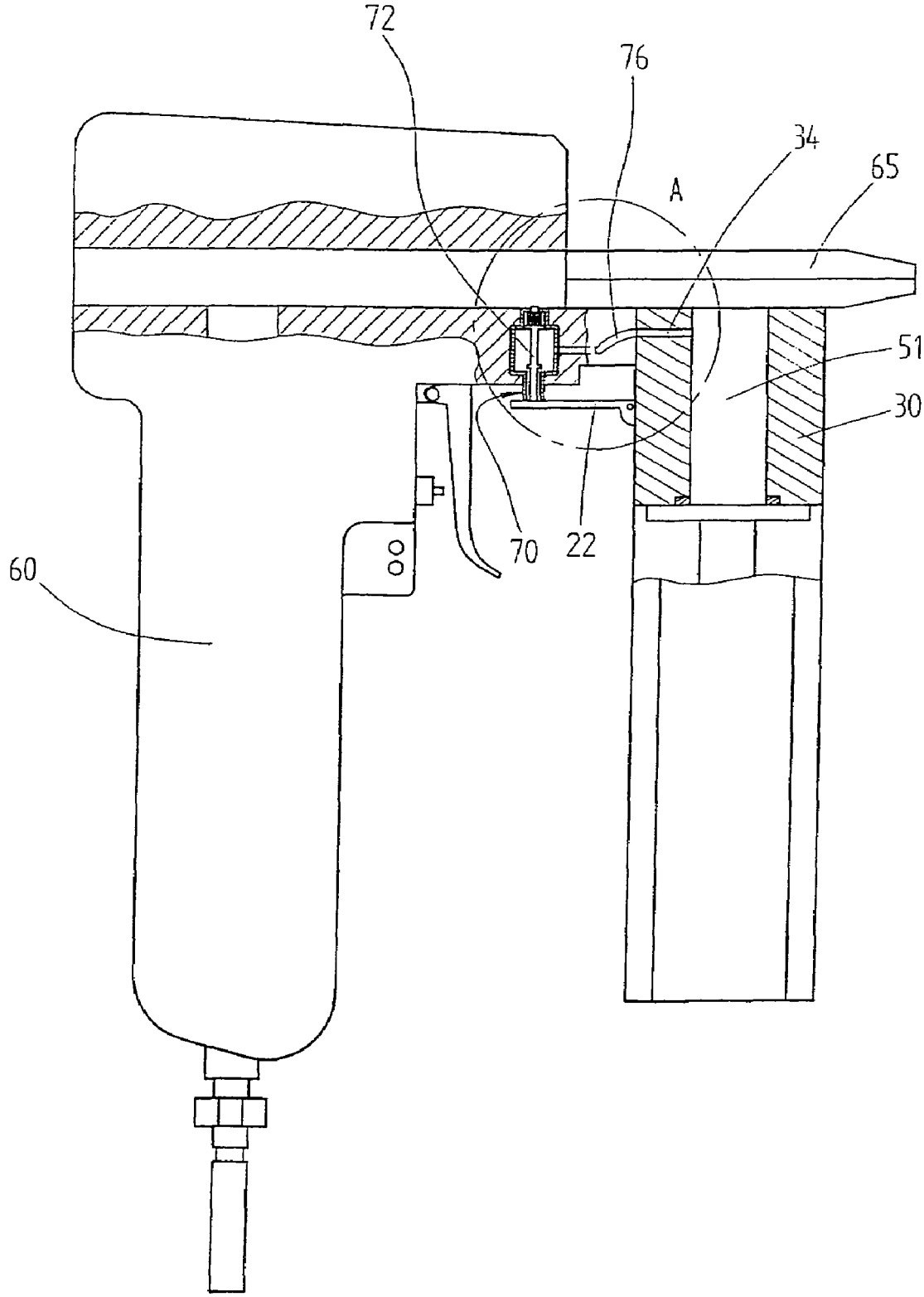
FIG. 4 is a side schematic view in partial cross-section of a nailer with the nailer magazine in FIG. 2 when feeding staples.

Referring to the drawings and initially to FIGS. 1, 2 and 4, a nailer magazine (10) in accordance with the present invention comprises a stationary part (30) stably mounted on a bottom of a striking portion (65) of a body (60) of the nailer and a sliding part (20) mounted to the stationary part (30) and slideable along the stationary part in a longitudinal direction. A feeding device (40) is mounted between the stationary part (30) and the sliding part (20) for pushing a set of fasteners in a preferred form of staples into the nailer. A retraction device (50) is mounted inside the stationary part (30). The retraction device (50) moves the feeding device (40) to a retracted position when detaching the sliding part (20) from the stationary part (30) and to a forward position for stably holding the staples when the sliding part (20) is mounted the stationary part and contacts a valve (70) mounted inside a bottom portion of the body (60) of the nailer.

Figure 3:
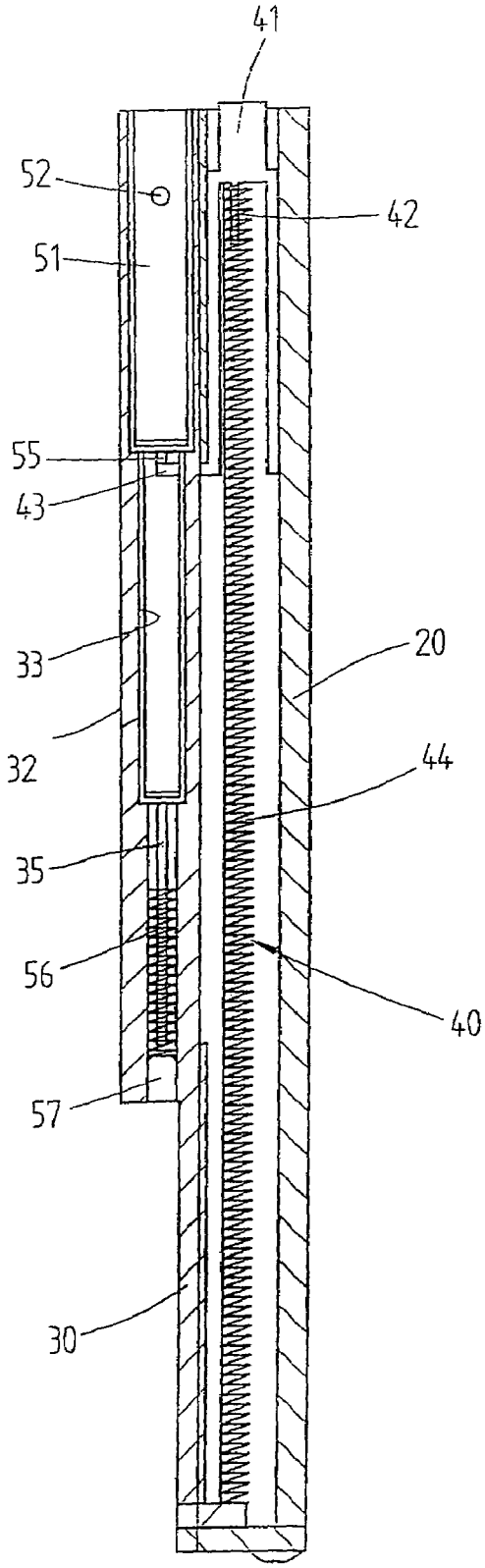
FIG. 3 is a front cross-sectional view of the nailer magazine in FIG. 2.

With reference to FIGS. 1-3, the sliding part (20) has a U-shaped cross-section. Multiple grooves (21) are longitudinally defined in an inner periphery of the sliding part (20) and facing the stationary part (30). A contacting plate (22) laterally extends from one side of the sliding part (20) and contacts with the valve (70) after slidably mounting the sliding part (20) to the stationary part (30). A bottom plate (25) is securely mounted to a lower end of the sliding part (20) for closing the lower distal end of the sliding part (20).

The stationary part (30) includes multiple grooves (31) longitudinally defined in one side thereof. Each groove (31) in the stationary part (30) communicates with a corresponding one of the multiple grooves (21) in the sliding part (20). Each groove (31) has an enlarged longitudinally extending portion (310) formed in a middle portion of each of the groove (31) in the stationary part (30). A block (32) extends from the stationary part (30) opposite to the sliding part (20). A hole (33) is longitudinally defined in and extends through the block (32). The hole (33) is divided into three sections each having an enlarged diameter. An inlet (34) is defined in the block (32) and laterally communicates with the hole (33). The block (32) includes a slot (35) longitudinally defined therein and laterally communicating with the hole (33) for guiding the retraction device (50). A bottom plate (37) is securely mounted to a lower end of the stationary part (30) for closing the multiple grooves (31) in the stationary part (30).

The feeding device (40) includes multiple U-shaped pushers (41) having two opposite ends respectively received in a corresponding one of the grooves (31, 21) in the stationary part (30) and the sliding part (20). Each pusher (41) has an insertion (42) extending therefrom for inserting into a spring (44) that is longitudinally received in the enlarged portion (310) of the corresponding one of the grooves (31) in the stationary part (30). A rod (43) laterally perpendicularly extends from each pusher (41) and received in the slot (35) and interacting with the retraction device (50) to drive the pusher (41) of the feeding device (40). A pushing plate (45) is received in the last grooves (31, 21) of the stationary part (30) and the sliding part (20) for limiting a thickness of the staples. Two plates (46, 47) are secured on two opposite sides of the stationary part (30) by multiple bolts (48) to form a gap between the stationary part (30) and the sliding part (20) for receiving the pushing plate (45). The structure of the pushing plate (45) is similar to that of the pusher (41), and the pushing plate (45) has an insertion (42) and a rod (43) extending from the pushing plate (45).

The retraction device (50) includes a shaft (51) reciprocally movably received in the hole (33). The shaft (51) has a shape corresponding to that of the hole (33). A through hole (52) is diametrically defined in the shaft (51) and selectively communicates with the inlet (34). A lateral rod (55) extends through the multiple pushers (41) and secured on a lower end of the shaft (51) to push the multiple pushers (41). A return spring (56) is received in a lower end of the hole (33), and a stopper (57) is securely received in the lower end of the hole (33) to prevent the return spring (56) from detaching from the stationary part (30). The return spring (56) provides a return force for the shaft (51).

Figure 4A:
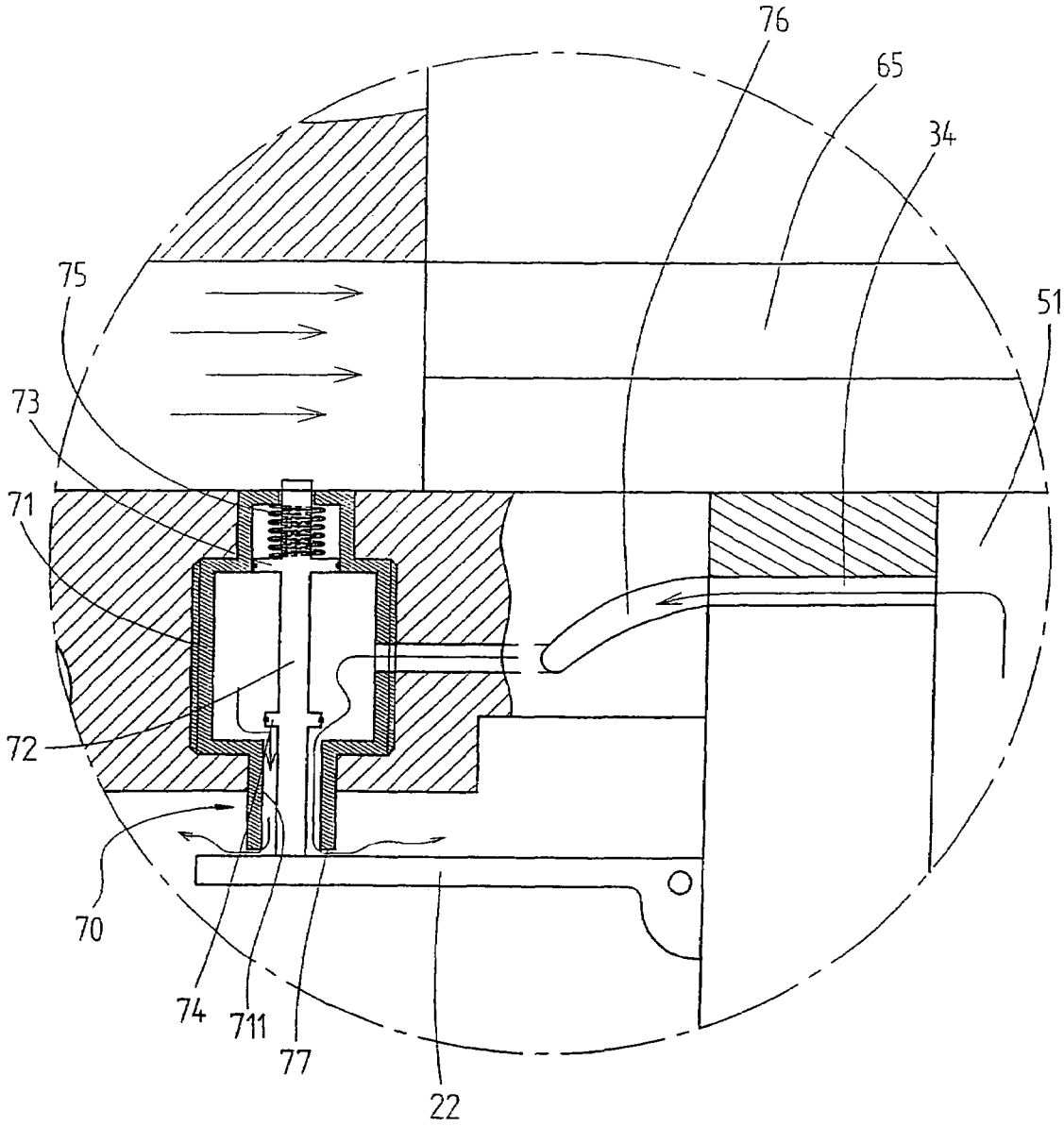
FIG. 4A is a partial enlarged view of the nailer in FIG. 4.

With reference to FIG. 4A, the valve (70) includes a hollow main body (71) with an upper passage (not numbered) and a lower passage (711) longitudinally corresponding to each other. An actuated rod (72) is movably received in the main body (71). The actuated rod (72) has a first flange (73) and a second flange (74) respectively radially extending therefrom for selectively closing the upper passage and the lower passage (711). A resilient member (75) is sleeved on an upper portion of the actuated rod (72) for providing a return force to the actuated rod (72) after the actuated rod (72) is upwardly pushed. An air path (76) is defined in the body (60) of the nailer and communicates with the upper passage and the inlet (34) in the stationary part (30).

Figure 5:
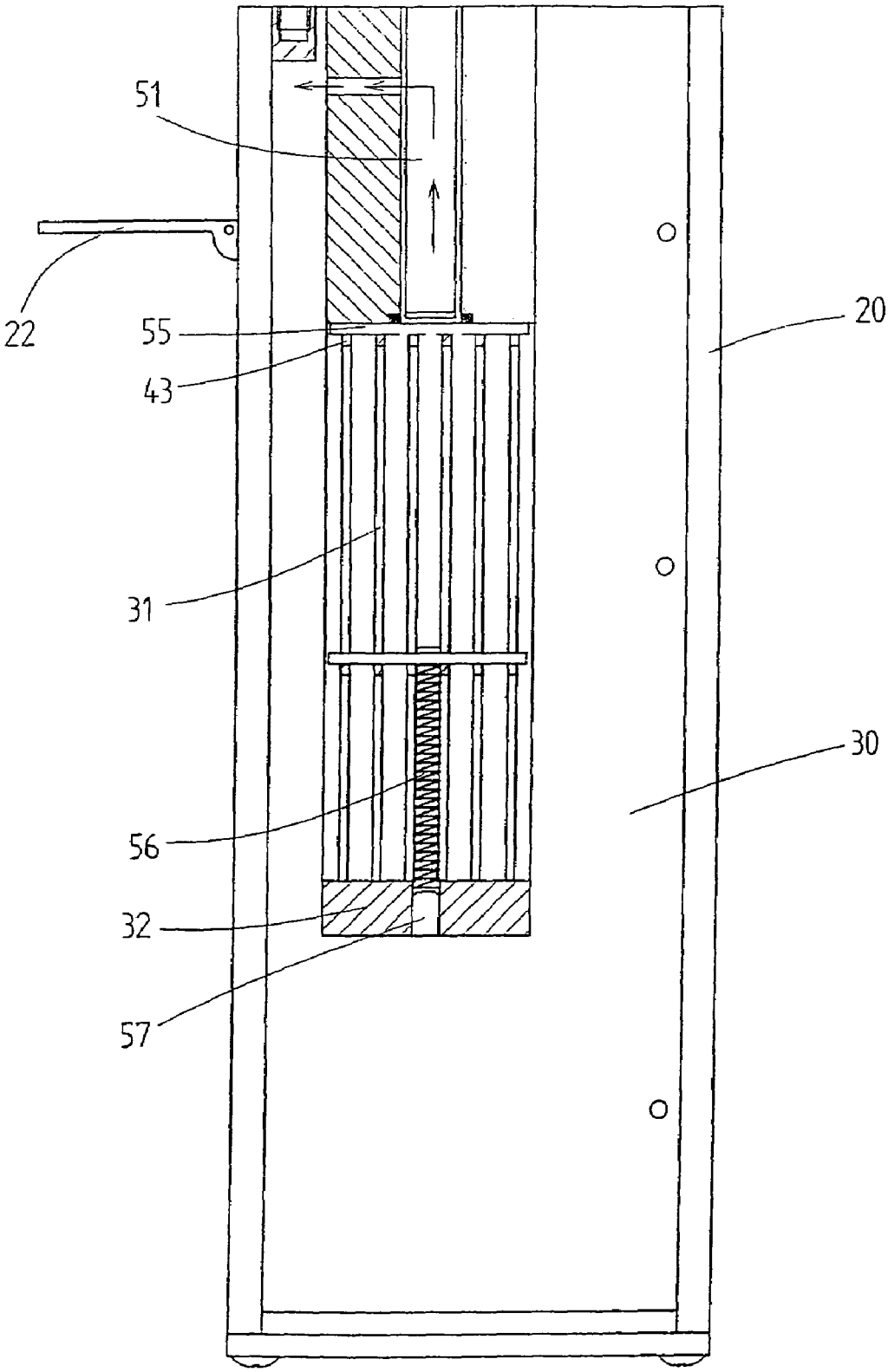
FIG. 5 is a side cross-sectional view of the nailer magazine in FIG. 2 when feeding staples.

With reference to FIGS. 3-5, the contacting plate (22) of the sliding part (20) upwardly pushes the actuated rod (72) for compressing the resilient member (75) to make the first flange (73) air tightly close the upper passage of the valve (70) and forming a gap (77) between the contacting plate (22) and the main body (71) of the valve (70) when the staples are disposed in the nailer magazine (10) and the sliding part (20) is upwardly pushed and in a forward position. As a result, the compressed air in the stationary part (30) is exhausted via the lower passage (711) of the valve (70) and the gap (77) between the contacting plate (22) and the main body (71) of the valve (70), and then the shaft (51) is in a free condition. Consequently, the return spring (56) upwardly pushes the lateral rod (55) and the shaft (51) to make the rod (43) of each of the multiple pushers (41) be disengaged from the lateral rod (55). As a result, the springs (44) upwardly push the multiple pushers (41) for feeding.

Figure 6:
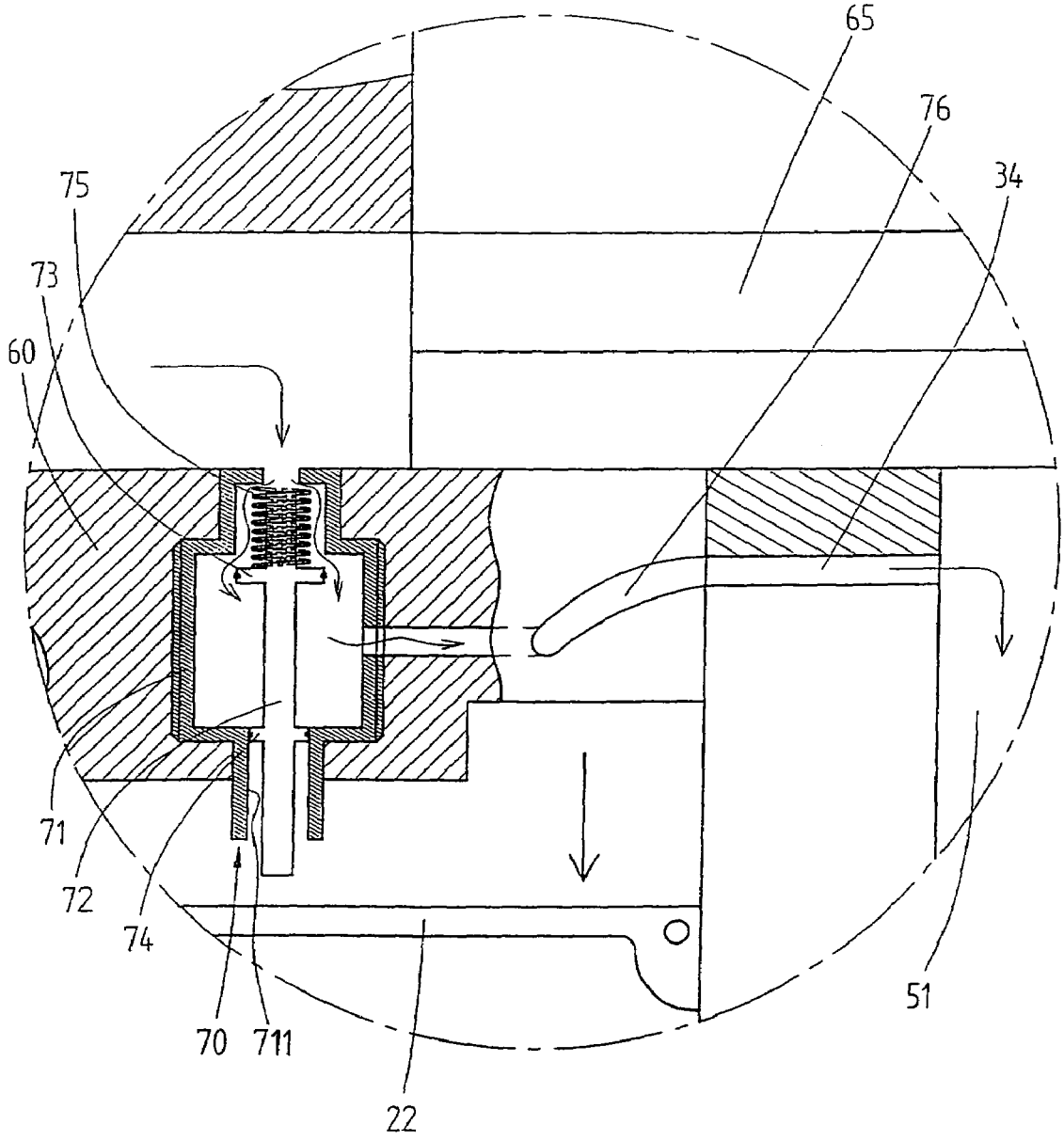
FIG. 6 is a partial enlarged view of the nailer in FIG. 4 when detaching the nailer magazine.
Figure 7:
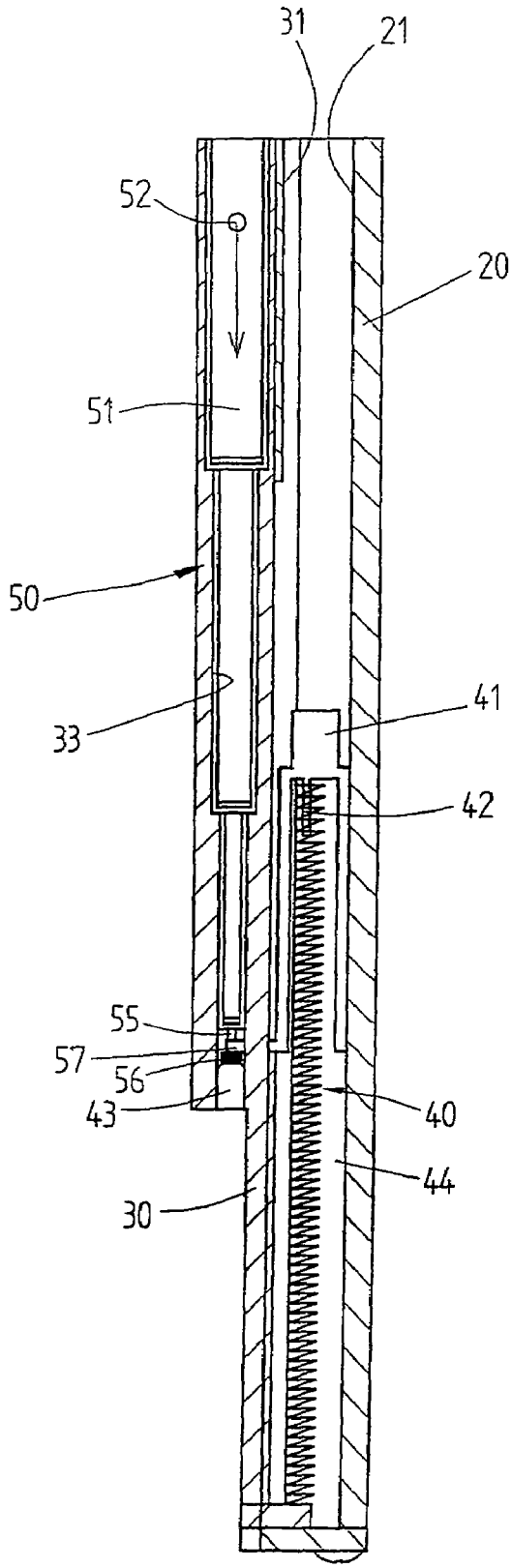
FIG. 7 is a side cross-sectional view of the nailer magazine in FIG. 2 when being detached from the nailer.

With reference to FIGS. 6 and 7, the contacting plate (22) of the sliding part (20) is moved away from the actuated rod (72) and the actuated rod (72) is downwardly moved relative to the return force of the resilient member (75) to make the second flange (74) air tightly close the lower passage (711) when the sliding part (20) is downwardly moved and in a retracted position. The compressed air flows into the valve (70) and the shaft (51) via the inlet (34) and through hole (52) to make the lateral rod (55) downwardly push the multiple pusher (41) and the pushing plate (45). As a result, the feeding device (40) is in a retracted position.

As described above, the sliding part (20) and the feeding device (40) are in a retracted position when reloading the staples. Consequently, the multiple pushers (41) do not push the staples at first. The staples are limited between the stationary part (30) and the sliding part (20) when the contacting plate (22) pushes the actuated rod (72) to exhaust the compressed air in the shaft (52) for making the multiple pushers (41) feed staples. As a result, the reloaded staples do not deform when the multiple pushers (41) firstly contact with the reloaded staples.

Although the invention has been explained in relation to its preferred embodiment, it is to be understood that many other possible modifications and variations can be made without departing from the spirit and scope of the invention as hereinafter claimed.

What is claimed is:

1. A nailer magazine for a nailer having a body and a striking portion, with the nailer magazine comprising a stationary part adapted to be stably mounted to the bottom of the striking portion of the nailer body, a sliding part mounted to the stationary part and slidable along the stationary part in a longitudinal direction, a feeding device mounted between the stationary part and the sliding part for pushing a set of fasteners into the nailer, a retraction device mounted inside the stationary part, the retraction device moving the feeding device to a retracted position when detaching the sliding part from the stationary part and to a forward position for stably holding the fasteners when the sliding part is mounted to the stationary part and contacts a valve mounted inside a bottom portion of the nailer body, so that a set of reloaded fasteners are held securely between the stationary part and the sliding part to prevent the reloaded fasteners from being deformed when the feeding device initially contacts the reloaded fasteners.

2. The nailer magazine as claimed in claim 1, wherein the sliding part includes multiple grooves longitudinally defined on an inner periphery of the sliding part and facing the stationary part, the stationary part also including multiple grooves longitudinally defined in one side thereof, wherein each groove in the stationary part communicates with a corresponding one of the multiple grooves in the sliding part, with the feeding device received in the grooves in the stationary part and the sliding part.

3. The nailer magazine as claimed in claim 2, wherein the stationary part includes a bottom plate securely mounted to a lower end for closing the multiple grooves in the stationary part.

4. The nailer magazine as claimed in claim 2, wherein the feeding device includes multiple U-shaped pushers having two opposite ends respectively received in the corresponding one of the grooves in the stationary part and the sliding part, a rod laterally perpendicularly extending from each pusher and interacting with the retraction device to drive the U-shaped pusher of the feeding device, and a pushing plate received in the last grooves of the stationary part and the sliding part for limiting a thickness of the fasteners.

5. The nailer magazine as claimed in claim 4, wherein two plates are secured on two opposite sides of the stationary part by multiple bolts to form a gap between the stationary part and the sliding part for receiving the pushing plate, and the rod extending from the pushing plate.

6. The nailer magazine as claimed in claim 4, wherein each groove in the stationary part has an enlarged longitudinally extending portion formed in a middle portion of each groove in the stationary part for receiving a spring that provides a return force to a corresponding one of the multiple pushers and the pushing plate.

7. The nailer magazine as claimed in claim 4, wherein a block extends from the stationary part opposite to the sliding part, a hole longitudinally defined in and extending through the block, the hole divided into three sections each having an enlarged diameter, an inlet defined in the block and laterally communicating with the hole, the block including a slot longitudinally defined therein and laterally communicating with the hole for guiding the retraction device.

8. The nailer magazine as claimed in claim 7, wherein the retraction device includes a return spring received in a lower end of the hole and a stopper secured received in the lower end of the hole to prevent the return spring from detaching from the stationary part, the return spring providing a return force for the shaft.

* * * * *